US005374047A

United States Patent [19]

Tsukamoto et al.

[11] Patent Number: 5,374,047

[45] Date of Patent: Dec. 20, 1994

[54] SHEET FEEDER

[75] Inventors: Masaaki Tsukamoto; Mitsuyoshi Uehara, both of Nagoya, Japan

[73] Assignee: Brother Kogyo Kabushiki Kaisha, Nagoya, Japan

[21] Appl. No.: 103,762

[22] Filed: Aug. 10, 1993

[30] Foreign Application Priority Data

Sep. 24, 1992 [JP] Japan ..... 4-066545[U]

[51] Int. Cl.[5] ..... B65H 3/06

[52] U.S. Cl. ..... 271/010; 271/121

[58] Field of Search ..... 271/121, 124, 167, 10

[56] References Cited

U.S. PATENT DOCUMENTS 4,588,182 5/1986 Nakanishi ..... 271/121
5,026,042 6/1991 Miller .
5,052,676 10/1991 Shiina ..... 271/121
5,102,115 4/1992 Takamizawa ..... 271/167 X
5,253,854 10/1993 Tanoue ..... 271/121 X

*Primary Examiner*—Richard A. Schacher
*Attorney, Agent, or Firm*—Oliff & Berridge

[57] ABSTRACT

In separating one of a plurality of sheets stacked in a cassette from the remainder, a separation pad holder facing one side of the circumference of a sheet feed roller, which is rotatably driven, is urged in such a manner that a separation pad is brought into contact with or separation from the circumference of the sheet feed roller. Accordingly, an uppermost sheet can be pushed out in separation by friction force. When the sheet reaches a pair of sheet feed rollers, the separation pad holder can retreat with the interference of a projection formed in the separation pad holder by its own tension of the sheet across each circumference of the sheet feed collars and the pair of sheet feed rollers, thus eliminating friction generated between the separation pad and the sheet.

18 Claims, 8 Drawing Sheets

SHEET FEEDER

BACKGROUND OF THE INVENTION

1. Field of the Invention

The present invention relates to a sheet feeder for feeding sheets one by one in separation to an image forming unit of an image forming apparatus such as an electrophotographic copying machine, a laser printer or a facsimile apparatus from a sheet cassette.

2. Description of the Related Art

Heretofore, there have been developed various kinds of sheet feeders for feeding cut sheets of a predetermined size in an image forming apparatus such as a laser printer. A friction separation type sheet feeder is well known as one example, and will be explained with reference to FIG. 9.

In this friction separation type sheet feeder, numerous pieces of sheets P are stacked on a receiving plate 115, which is urged upward, housed inside a sheet cassette 102. A sheet feed shaft 117, which is intermittently rotated, is disposed above at the edge of the uppermost one P1 of the sheets P. In the middle of the feed shaft 117 is fixed a sheet feed roller 106 constituted by a member formed into a substantially D-shaped cross section and having a high friction coefficient at the circumference thereof. A pair of cylindrical sheet feed collars 116 each having a radius a little smaller than that of the circumference of the feed roller 106 are attached to both ends of the feed roller 106 for free rotation on the feed shaft 117. When the feed shaft 117 is rotated by a predetermined angle by a motor, the circumference of the feed roller 106 is pressed in contact with the uppermost sheet P1, which is pushed out forward (downstream of a feed direction) by friction generated on the circumference of the feed roller 106.

Sheets under the uppermost sheet P1 may be accidentally drawn out together. This phenomenon is generally called "dual feed." A separation pad holder 119 made of a synthetic resin is conventionally disposed near the uppermost sheet P1 just downstream of the feed direction for the purpose of prevention of dual feed. A separation pad 126 such as rubber having a friction coefficient smaller than that of a material of the feed roller 106 is attached onto the upper surface of the pad holder 119 (i.e., on a side facing the circumference of the feed roller 106). The pad holder 119 is urged so as to approach the circumference of the feed roller 106 by a spring 125.

In such a state that the circumference of the rotating feed roller 106 faces the pad 126, the pad holder 119 is pushed down against force of the spring 125 via the sheet. In this state, the uppermost sheet P1 is pushed forward by the friction force generated on the circumference of the feed roller 106. Because resistance for inhibiting pushing-out acts on the sheets under the uppermost sheet P1 by the friction force of the pad 126, only one sheet, i.e., only the uppermost sheet P1 can be pushed out to be fed between a pair of feed rollers 107 disposed downstream of the feed direction beyond the pad holder 119.

Meanwhile, in such a state that a flat portion 106a having a smaller radius faces the pad holder 119 after the feed roller 106 is rotated by a preset angle, the circumferences of the freely rotatable feed collars 116 each having a radius larger than that of the flat portion 106a are brought into contact with the upper surface of the sheet to be fed so that the reverse of the sheet comes into contact with the pad 126.

However, friction is generated between the reverse of the sheet and the surface of the pad 126 since the uppermost sheet P1 is pressed in contact with the feed collars 116 and the pad 126 while the sheet (the uppermost sheet P1), which has been fed in separation by the feed roller 106 and the pad 126, is fed by the pair of feed rollers 107, with an attendant problem of generation of large friction noise.

SUMMARY OF THE INVENTION

The present invention has been accomplished in an attempt to solve the above problem observed in the prior art. An object of the invention is to provide a sheet feeder of a simple construction where noise can be prevented from being generated without deteriorating a sheet separating function.

In order to achieve the above-stated object, the sheet feeder according to the present invention comprises: a sheet feed roller for feeding a single sheet out of a plurality of stacked sheets; a sheet separating mechanism for frictionally separating the sheet by a holder having a separation pad attached thereonto; a sheet feeding mechanism disposed downstream of a sheet feed path beyond the sheet separating mechanism; and a projection formed on the surface of the holder downstream of the sheet feed path, for urging the holder facing one side of the circumference of the sheet feed roller in such a manner that the surface of the separation pad is brought into contact with or separation from the circumference of the sheet feed roller and for separating the separation pad from the reverse of the sheet by the sheet across the sheet feeding mechanism and the circumference of the sheet feed roller.

With this construction, in separating a single stacked sheet from the remainder of the stacked sheets, the holder facing one side of the circumference of the sheet feed roller is urged in such a manner that the separation pad is brought into contact with or separation from the circumference of the sheet feed roller, and accordingly, the sheet can be pushed out in separation by friction force. When the sheet to be fed reaches the sheet feeding mechanism, the holder can retreat with the interference of the projection formed in the holder by its own tension of the sheet across the sheet feeding mechanism and the sheet separating mechanism, thus preventing friction from being generated between the separation pad and the sheet to be fed. Consequently, it is possible to prevent abnormal noise from being generated by the friction of the sheet in the sheet feed operation. Formation of the projection on a known holder can make the construction remarkably simple with an advantage of a low cost.

DETAILED DESCRIPTION OF A PREFERRED EMBODIMENT

Figure 1:
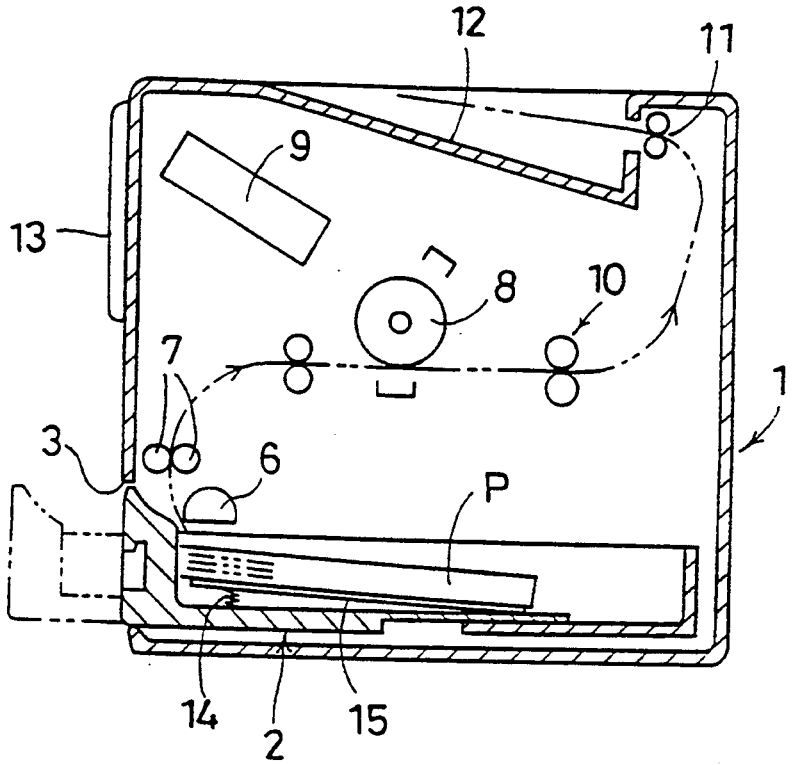
FIG. 1 is a sectional side view showing an image forming apparatus.
Figure 2:
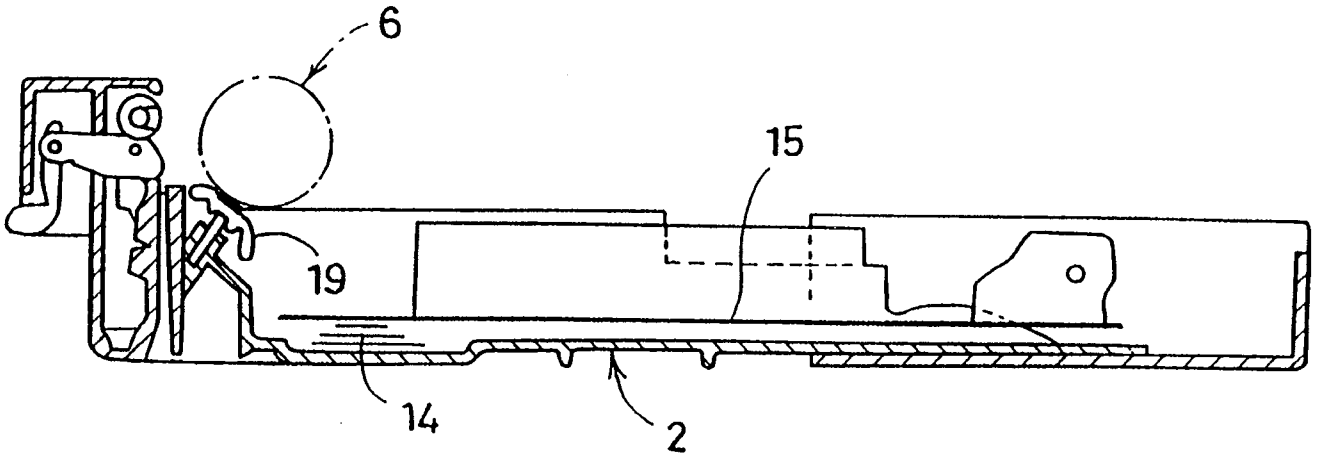
FIG. 2 is a sectional side view showing a cassette.
Figure 3:
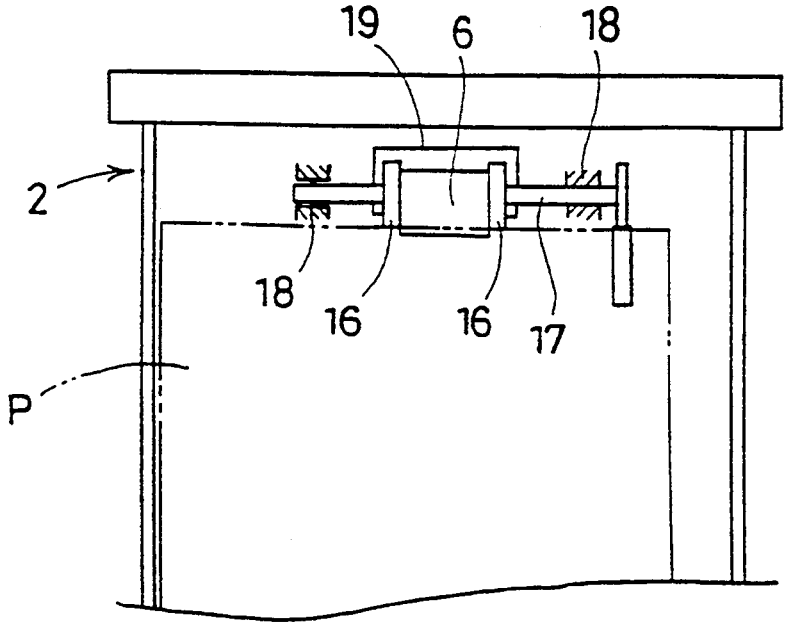
FIG. 3 is a schematic plan view showing a sheet feed roller.

Referring to FIGS. 1 and 2, a preferred embodiment of the present invention will be described in detail. In a main body 1 of a laser printer as an image forming apparatus is housed a cassette 2, as a casing, containing sheets P therein, having an upper opening and formed into a substantially rectangular shape in plan view. An insertion inlet 3 is formed in the lower portion of the main body 1. Guide rails for supporting right and left sides of the cassette 2 for freely lengthwise movement are disposed contiguously to the insertion inlet 3 inside the main body 1.

The sheets P stacked in the cassette 2 are turned up one by one by a sheet feed roller 6 of a sheet feeder provided in the vicinity of the insertion inlet 3 inside the main body 1, to be fed toward a photosensitive drum 8 through a pair of feed rollers 7 as a sheet feed mechanism. Toner is applied by electric charge onto an electrostatic latent image formed on the photosensitive drum 8 by a laser ray on the basis of a print (image) signal output from a laser/scanner 9 provided with a laser unit or a rotary polygon member, to be thus transferred onto the sheet P. The image is fixed on the sheet P in a fixing unit mechanism 10. The sheet P is discharged to a sheet discharge tray 12 through a sheet discharge unit mechanism 11. A console panel unit 13 is attached to the front surface of the main body 1.

The construction of the sheet separation mechanism and sheet feed mechanism in the sheet feeder will be described referring to FIGS. 1 and 4.

The cassette 2 comprises a frame made of a synthetic resin. On the bottom plate of the cassette 2 are mounted a tilting plate 15 for turnably supporting the base end of the cassette 2 and being urged upward by a spring 14 in such a manner as to bring each tip end of the plural stacked sheets P into contact with the feed roller 6, and side guide plates for aligning each side of the sheets P stacked on the tilting plate 15. The uppermost sheet P1 is pushed up at an end of the upper surface thereof so as to be brought into contact with the circumferences of sheet feed collars 16, 16 attached to the right and left sides of the feed roller 6.

Figure 4:
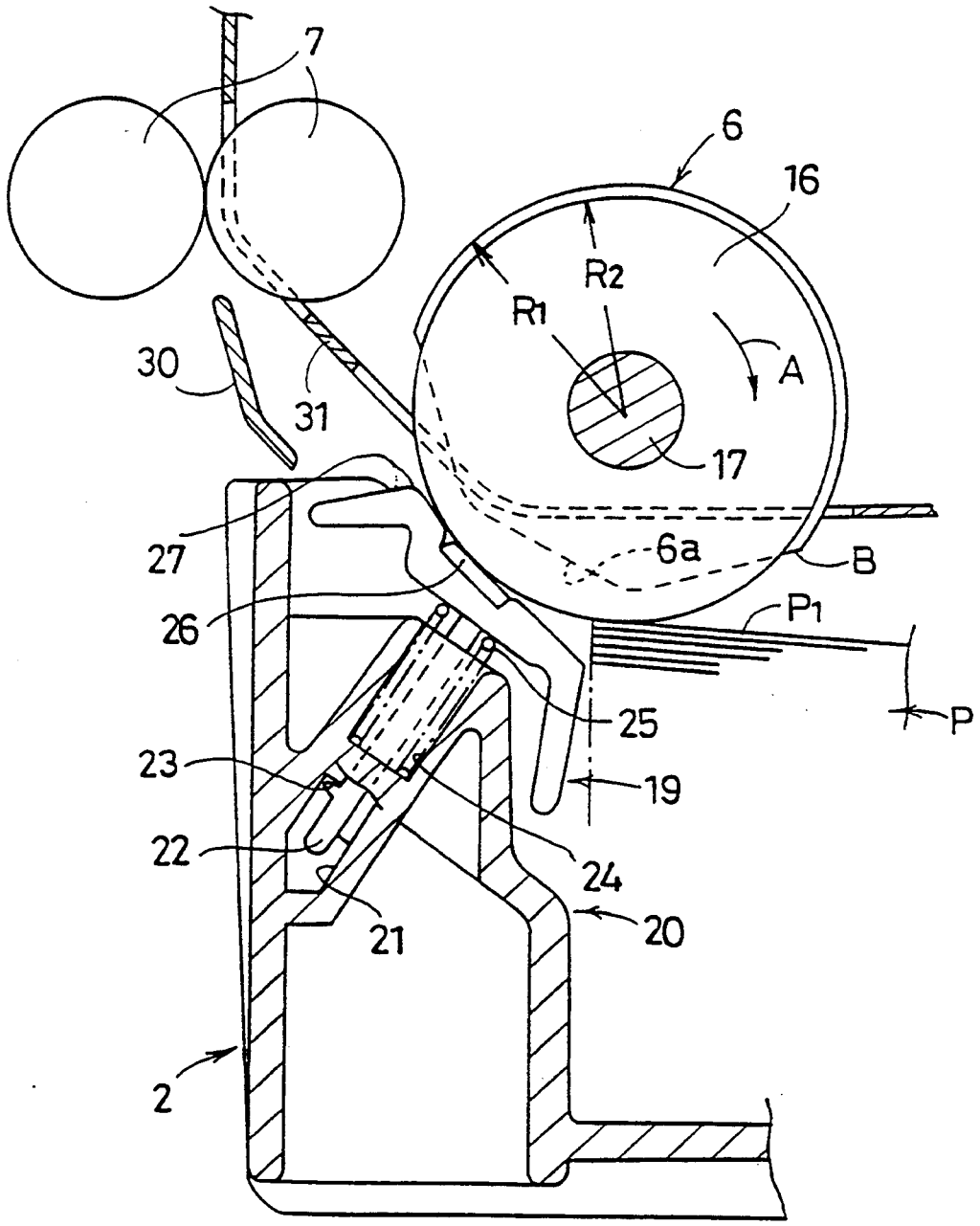
FIG. 4 is an enlarged sectional side view showing essential parts of a sheet separating mechanism and sheet feeding mechanism.
Figure 5:
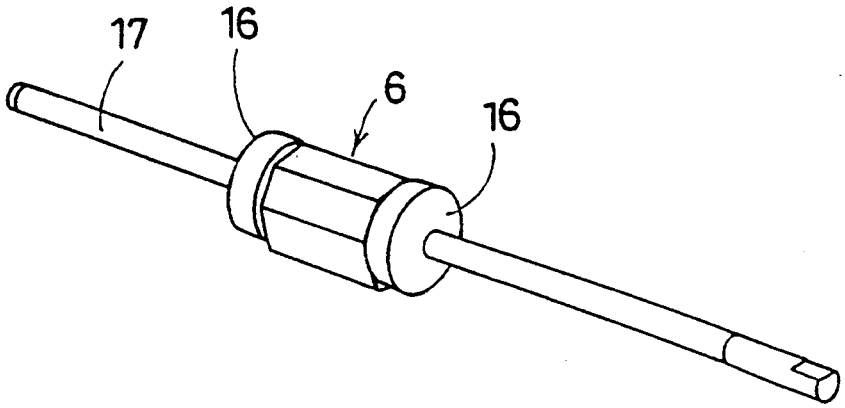
FIG. 5 is a perspective view showing the sheet feed roller and sheet feed collars.

As shown in FIG. 5, the feed roller 6 is fixed in the middle of a sheet feed shaft 17 in the longitudinal direction. The wheel type feed collars 16, 16 are attached onto the right and left sides of the feed roller 6 for free rotation. The feed shaft 17 is pivotably supported on bearings 18, 18 disposed inside the main body I, and is adapted to be intermittently rotated one time by a drive means, not shown, on the basis of a sheet feed command signal in a direction indicated by an arrow A in FIG. 4.

The feed roller 6 and the feed collars 16, 16 are made of a synthetic resin. The feed roller 6 is formed into a substantially D-shaped cross section, and at least the surface of its circumference has a high friction coefficient. A radius R1 of the circumference of the feed roller 6 is set slightly larger than a radius R2 of the circumference of the feed collar 16. A D-shaped portion 6a having a smaller radius is positioned inside the circumference of each feed collar 16.

Figure 6:
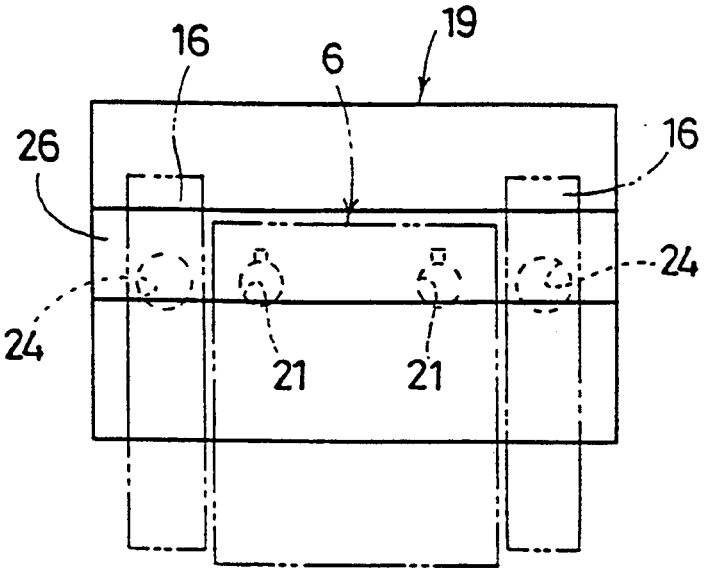
FIG. 6 is a plan view showing a separation pad holder.
Figure 7:
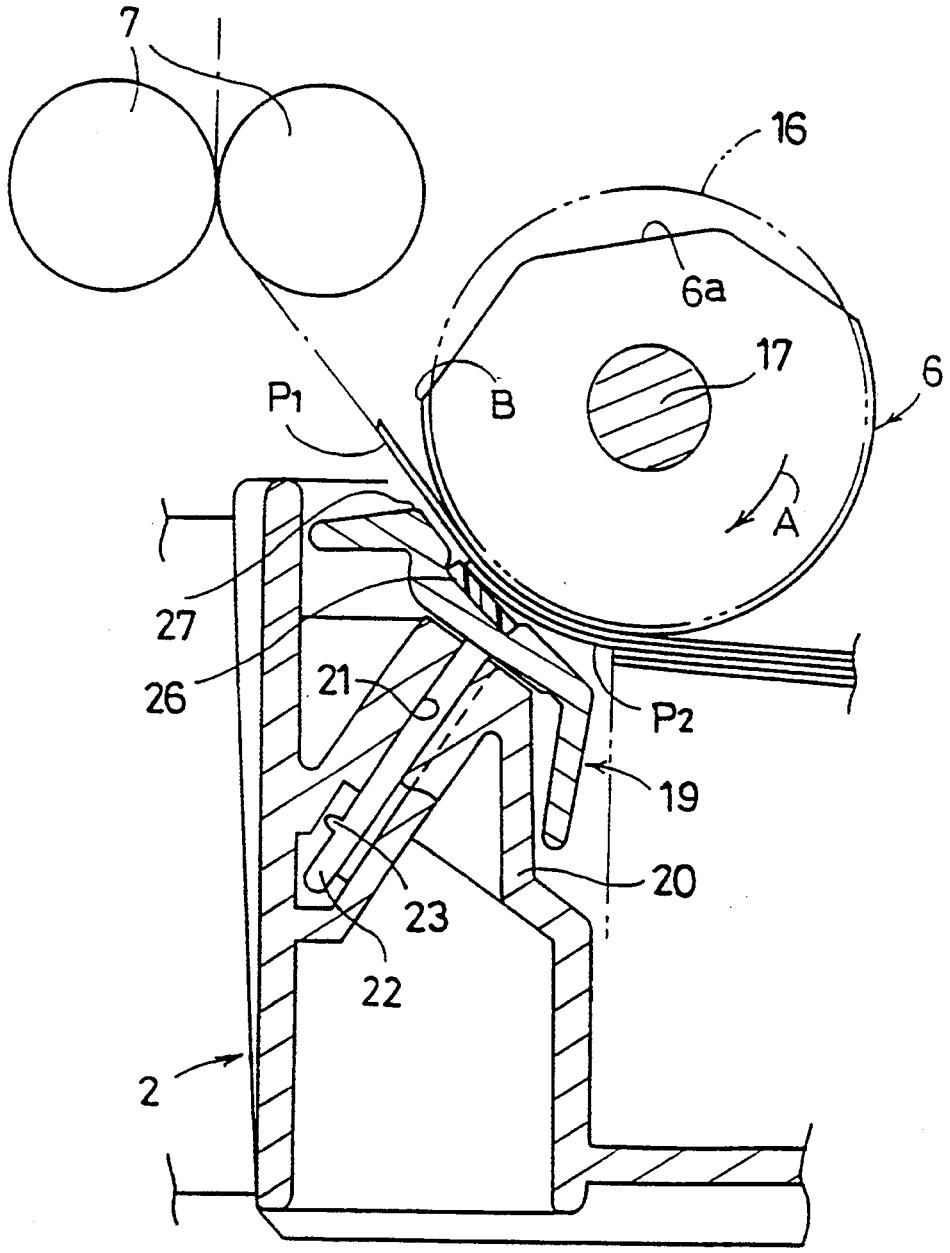
FIG. 7 is a view of assistance in explaining the sheet separating operation.

A separation pad holder 19 disposed near the front portion of the cassette 2 is disposed to face the lower portions of the feed roller 6 and feed collars 16, 16. Guide pins 22, 22 projecting downward from the underside of the pad holder 19 are slidably inserted into at least two support holes 21, 21 bored slantwise upward and backward in a support frame 20 of the cassette 2. A hook 23 formed in the guide pin 22 is adapted to prevent the pad holder 19 from being drawn out upward. A pair of coil springs 25, 25 are inserted into a corresponding pair of elongated holes 24, 24 formed in the support frame 20 outside of the support holes 21, 21 (FIG. 6) so as to urge the pad holder 19 toward the feed roller 6 and the feed collars 16, 16.

Onto the pad holder 19 is attached a laterally long separation pad 26 constituted of a member having a high friction coefficient such as rubber in such a manner as to extend in the axial direction of the feed shaft 17. A projection 27 is formed integrally with the pad holder 19 on a side of the pad holder 19 near a pair of feed rollers 7 as a sheet feed mechanism.

With the above-described construction, the D-shaped portion 6a having the smaller radius, the feed roller 6 faces the pad holder 19 in preparation of sheet feed as illustrated in FIG. 4, and the upper surface of the uppermost one P1 of the sheets P stacked on the cassette 2 is pressed in contact with each circumference of the feed collars 16, 16.

When the feed shaft 17 is rotated upon receipt of a sheet feed command so that a point B on the circumference of the feed roller 6 is brought into contact with the uppermost sheet P1, the sheets P (not necessarily one piece) are pushed toward the pad holder 19 by a friction force generated on the circumference of the feed roller 6. When each tip end of the plural sheets P abuts the pad 26 attached to the pad holder 19, the pad holder 19 falls down against urging force of the coil spring 25. The coefficient of friction between the first sheet P1 and the feed roller 6 is higher than the coefficient of friction between the second sheet P2 and the pad 26, which is still higher than the coefficient of friction between sheets P1 and P2. Accordingly, the second sheet P2 and the following sheets can be inhibited from being pushed out by frictional resistance generated on the pad 26 in a direction opposite to the pushing direction, and as a result, they can stay on the pad 26 while the uppermost sheet P1 can be pushed out along the circumference of the feed roller 6.

After the tip end of the uppermost sheet P1 is separated from the circumference of the feed roller 6, the sheet P1 is introduced toward the pair of feed rollers 7 along guide plates 30, 31 (see FIG. 4).

Figure 8:
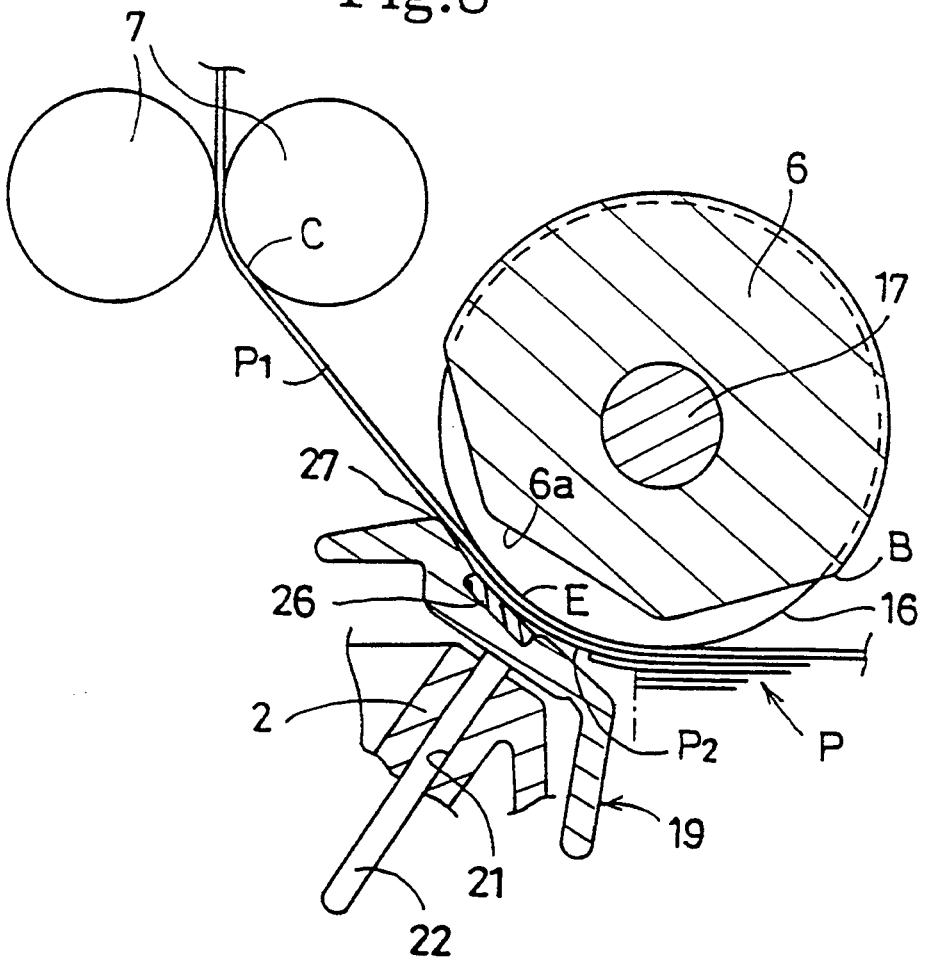
FIG. 8 is a view of assistance in explaining the sheet feeding operation.
Figure 9:
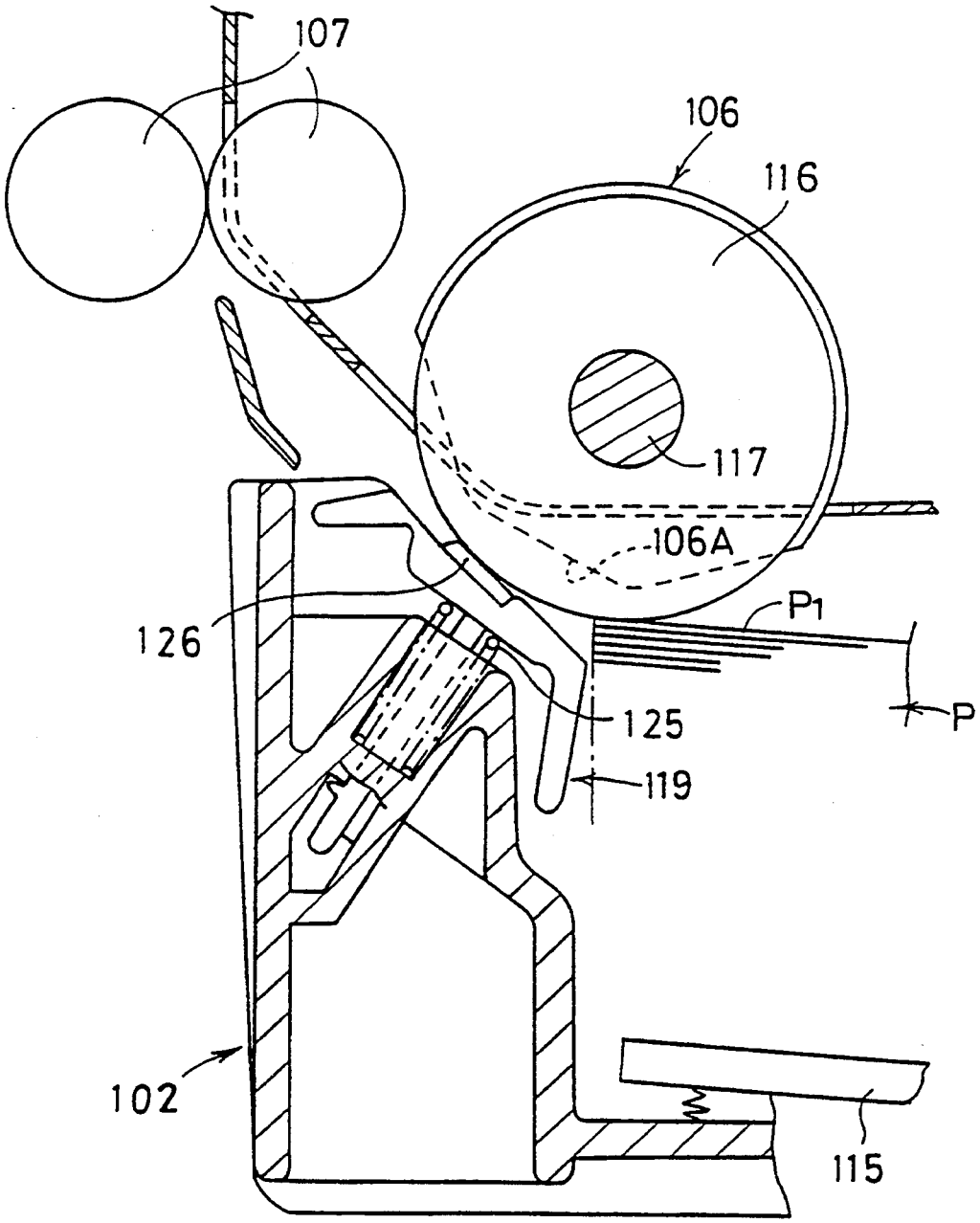
Fig.9 RELATED ART
FIG. 9 is an enlarged sectional side view showing essential parts of a conventional image forming apparatus.

As depicted in FIG. 8, the D-shaped portion 6a of the feed roller 6 faces the pad holder 19 with the tip end of the uppermost sheet P1 held between the pair of feed rollers 7, and the rotation is stopped. Consequently, the uppermost sheet P1 is positioned on a feed path connecting each circumference of the rotatable feed collars 16, 16 to the circumference of one of the feed rollers 7 in the shortest distance (i.e., on a line connecting points C and E to each other in FIG. 8), and moreover, tension is applied to the uppermost sheet P1 between the points C and E.

Since the projection 27 formed in the pad holder 19 projects to intersect the feed path, the projection 27 is pushed downward by the underside of the uppermost sheet P1 with the application of tension so that the pad holder 19 slightly falls down. This operation can reduce the force of the coil spring 25 for urging the pad holder 19 toward the feed roller 6 and the feed collars 16, 16. Furthermore, slide-contact friction generated between the stationary pad 26 and the uppermost sheet P1 can be eliminated, thus preventing generation of abnormal noise.

If a slide-contact area between the projection 27 and the uppermost sheet P1 is reduced, abnormal noise can be prevented from being generated due to the slide-contact friction. Accordingly, it is preferable that the projection 27 should be formed into a three-dimensional shape such as a hemisphere.

The pad holder 19 falls down by the contact between the projection 27 and the underside of the uppermost sheet P1 so that the second sheet P2 and the following sheets staying on the pad 26 can be prevented from being strongly pushed against the underside of the uppermost sheet P1, whereby a phenomenon of dual feed can be prevented. Moreover, the sheet to be fed and the stationary sheet (which is inhibited from being fed) right under the sheet to be fed are brought into contact with each other in a large area, and consequently, friction noise can be prevented from being generated during slide-contact.

What is claimed is:

1. A sheet feeder, comprising:

first feeding means for feeding a first sheet from a plurality of stacked sheets to second feeding means;

preventing means for preventing a second sheet from being fed with said first sheet; and means disposed in a sheet path between said first feeding means and said second feeding means for separating said preventing means from said first feeding means.

2. A sheet feeder as claimed in claim 1, wherein said preventing means comprises a separation pad holder holding a separation pad, said separation pad being urged against said first feeding means by a spring such that said first sheet is fed between said separation pad and said first feeding means.

3. A sheet feeder as claimed in claim 2, wherein said separating means comprises a projection coupled to said separation pad holder, wherein when said first sheet is fed to said second feeding means, tension in said first sheet causes said first sheet to contact said projection thereby urging said separation pad holder and said separation pad against the force of said spring to separate from said first sheet.

4. A sheet feeder as claimed in claim 3, wherein said separation pad holder comprises at least one guide pin fixed on a side of said separation pad holder opposite said first feeding means, said at least one guide pin being disposed in a corresponding at least one support hole in a support frame, said support frame accommodating the plurality of stacked sheets.

5. A sheet feeder as claimed in claim 4, wherein said at least one guide pin comprises a hook shaped to prevent said at least one guide pin and said separation pad holder from being drawn from said corresponding at least one support hole.

6. A sheet feeder as claimed in claim 3, wherein said spring is disposed in a support hole in a support frame, said support frame accommodating the plurality of stacked sheets.

7. A sheet feeder as claimed in claim 2, wherein a surface of said first feeding means has a first coefficient of friction and said separation pad has a second coefficient of friction lower than said first coefficient of friction of said first feeding means.

8. A sheet feeder as claimed in claim 7, wherein said second coefficient of friction is higher than a coefficient of friction between said first sheet and said second sheet.

9. A sheet feeder comprising:

a sheet feed roller for feeding a sheet from a plurality of stacked sheets;

a sheet separating mechanism for frictionally separating the sheet from said plurality of stacked sheets, said sheet separating mechanism comprising a holder and a separation pad, said separation pad being attached to said holder, wherein said holder faces one side of a circumference of said sheet feed roller;

a sheet feeding mechanism disposed downstream of a sheet feed path beyond said sheet separating mechanism; and a projection formed on the surface of the holder downstream of the sheet feed path, for urging the holder away from the circumference of said sheet feed roller and for separating the separation pad from the sheet.

10. A sheet feeder as claimed in claim 9, wherein said holder is urged against the circumference of said sheet feed roller by a spring.

11. A sheet feeder as claimed in claim 10, wherein said holder comprises at least one guide pin fixed on a side of said pad holder opposite the circumference of said sheet feed roller, said at least one guide pin being disposed in a corresponding at least one support hole in a support frame, said support frame accommodating the plurality of stacked sheets.

12. A sheet feeder as claimed in claim 11, wherein said at least one guide pin comprises a hook shaped to prevent said at least one guide pin and said holder from being drawn from said corresponding at least one support hole.

13. A sheet feeder as claimed in claim 10, wherein said spring is disposed in a support hole in a support frame, said support frame accommodating the plurality of stacked sheets.

14. A sheet feeder as claimed in claim 9, wherein a surface of said sheet feed roller has a first coefficient of friction and said separation pad has a second coefficient of friction lower than said first coefficient of friction of said sheet feed roller.

15. A sheet feeder as claimed in claim wherein said second coefficient of friction is higher than a coefficient of friction between said sheet and a second sheet.

16. A sheet feeder as claimed in claim 9, wherein said projection is disposed in said sheet feed path between said sheet feed roller and said sheet feeding mechanism, wherein when said sheet is fed to said sheet feeding mechanism, tension in said sheet causes said sheet to contact said projection thereby urging said holder away from the circumference of said sheet feed roller.

17. A sheet feeding apparatus comprising:

a cassette for accommodating a plurality of sheets;

a first feed roller for feeding a first sheet from the plurality of sheets to a second feed roller;

a separation pad holder comprising a separation pad facing one side of a circumference of said first feed roller, a first coefficient of friction between said first feed roller and the first sheet being higher than a second coefficient of friction between said separation pad and a second sheet succeeding the first sheet;

a spring urging separation pad against said first feed roller; and a projection attached to said separation pad holder and disposed in a sheet path between said first feed roller and said second feed roller, a tension of the first sheet between said first feed roller and said second feed roller urging said projection and said separation pad to separate from the first feed roller.

18. A sheet feeder comprising:

a sheet feed roller for feeding a sheet from a plurality of stacked sheets;

a sheet separating mechanism for frictionally separating the sheet from said plurality of stacked sheets, said sheet separating mechanism comprising a holder and a separation pad, said separation pad being attached to said holder, wherein said holder faces one side of a circumference of said sheet feed roller;

a sheet feeding mechanism disposed downstream of a sheet feed path beyond said sheet separating mechanism; and a projection formed on the surface of the holder downstream of the sheet feed path, for urging the holder away from the circumference of said sheet feed roller and for separating the separation pad from the sheet, wherein said holder comprises at least one guide pin fixed on a side of said pad holder opposite the circumference of said sheet feed roller, said at least one guide pin being disposed in a corresponding at least one support hole in a support frame.

* * * * *